United States Patent [19]

Crain et al.

[11] 4,366,645

[45] Jan. 4, 1983

[54] STEERING MECHANISM FOR TOY VEHICLES

[75] Inventors: Philip W. Crain, San Pedro; James E. Morse, Lawndale, both of Calif.

[73] Assignee: Mattel, Inc., Hawthorne, Calif.

[21] Appl. No.: 232,759

[22] Filed: Feb. 9, 1981

[51] Int. Cl.[3] ..... A63H 11/10

[52] U.S. Cl. ..... 46/201; 46/219

[58] Field of Search ..... 46/201, 210, 215, 219, 46/202, 205, 262; 280/774, 97, 86, 771, 1.11 R, 46

[56] References Cited

U.S. PATENT DOCUMENTS

| | | | |
|---|---|---|---|
| 2,233,116 | 2/1941 | Voorheis | 46/201 |
| 2,642,700 | 6/1953 | Zimmer | 46/201 |
| 2,651,882 | 9/1953 | Core | 46/201 |
| 2,797,922 | 7/1957 | Thompson et al. | 273/1 |
| 2,859,975 | 11/1958 | Weaver et al. | 280/771 X |
| 3,747,265 | 7/1973 | Gagnon | 46/210 |
| 3,949,999 | 4/1976 | Breslow | 280/1.11 R |
| 4,030,243 | 6/1977 | Drucker | 46/205 X |

*Primary Examiner*—Gene Mancene
*Assistant Examiner*—Mickey Yu
*Attorney, Agent, or Firm*—Ronald M. Goldman; Max E. Shirk; Roy A. Ekstvand

[57] ABSTRACT

A toy vehicle (12) including a tractor (14) and a semi-trailer (16) is steered by a steering wheel (84) rotatably mounted to the semi-trailer (16) and linked to the rear end of the tractor (14) laterally of its 5th wheel pivot (52) by a rod (88) which swings the tractor (14) about the pivot (52) when the steering wheel (84) is rotated.

5 Claims, 11 Drawing Figures

12
14
16
18
30
32
36
38
42
46
50
52
54
64
68
70
72
74
76
84
98
10
100

12
14
16
18
20
38
40
42
44
46
48
54
56
58
60
62
64
66
76
86
90
91
93
94
96
72
10
90°

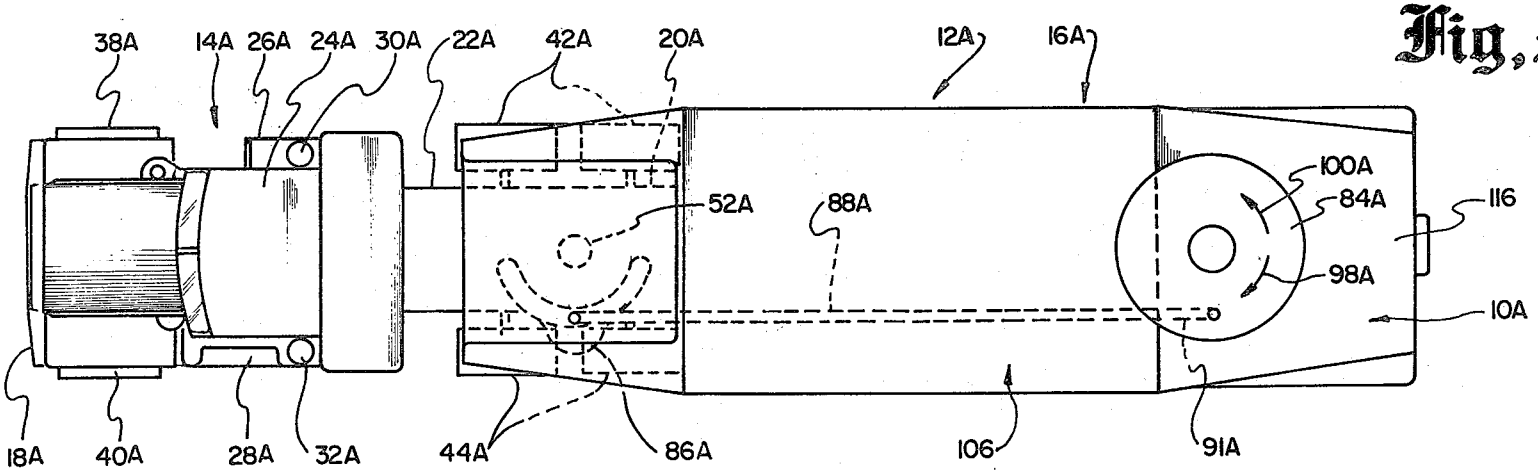
Fig. 5,
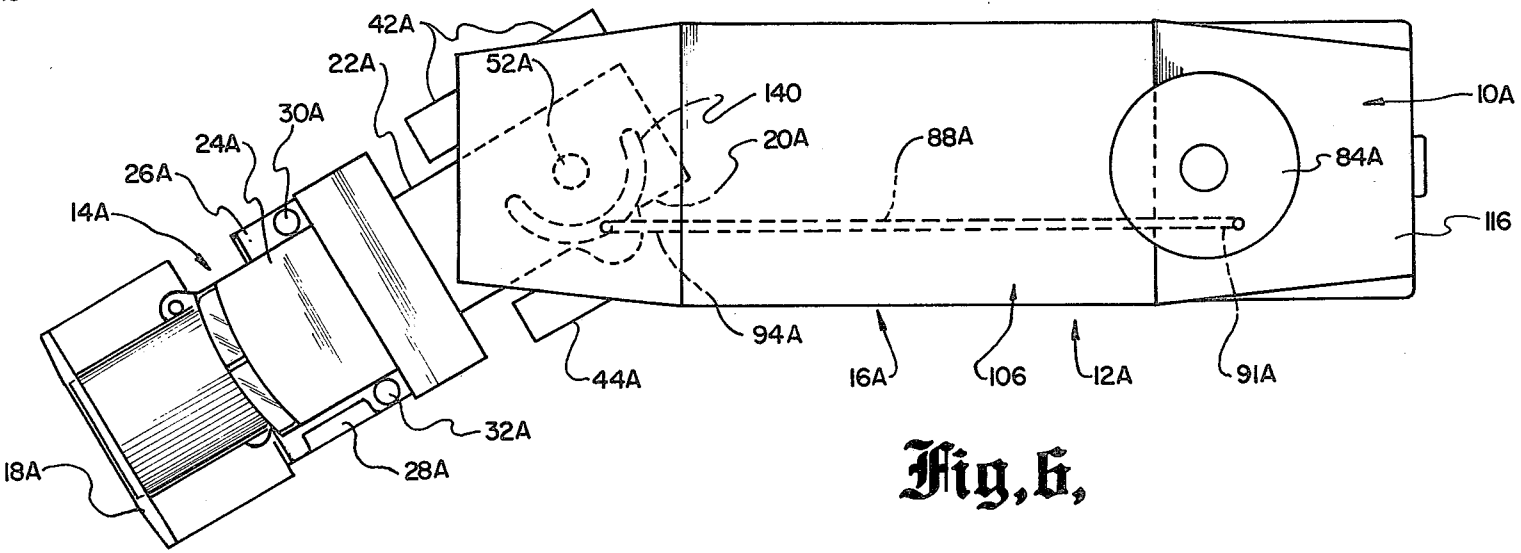
Fig. 6,

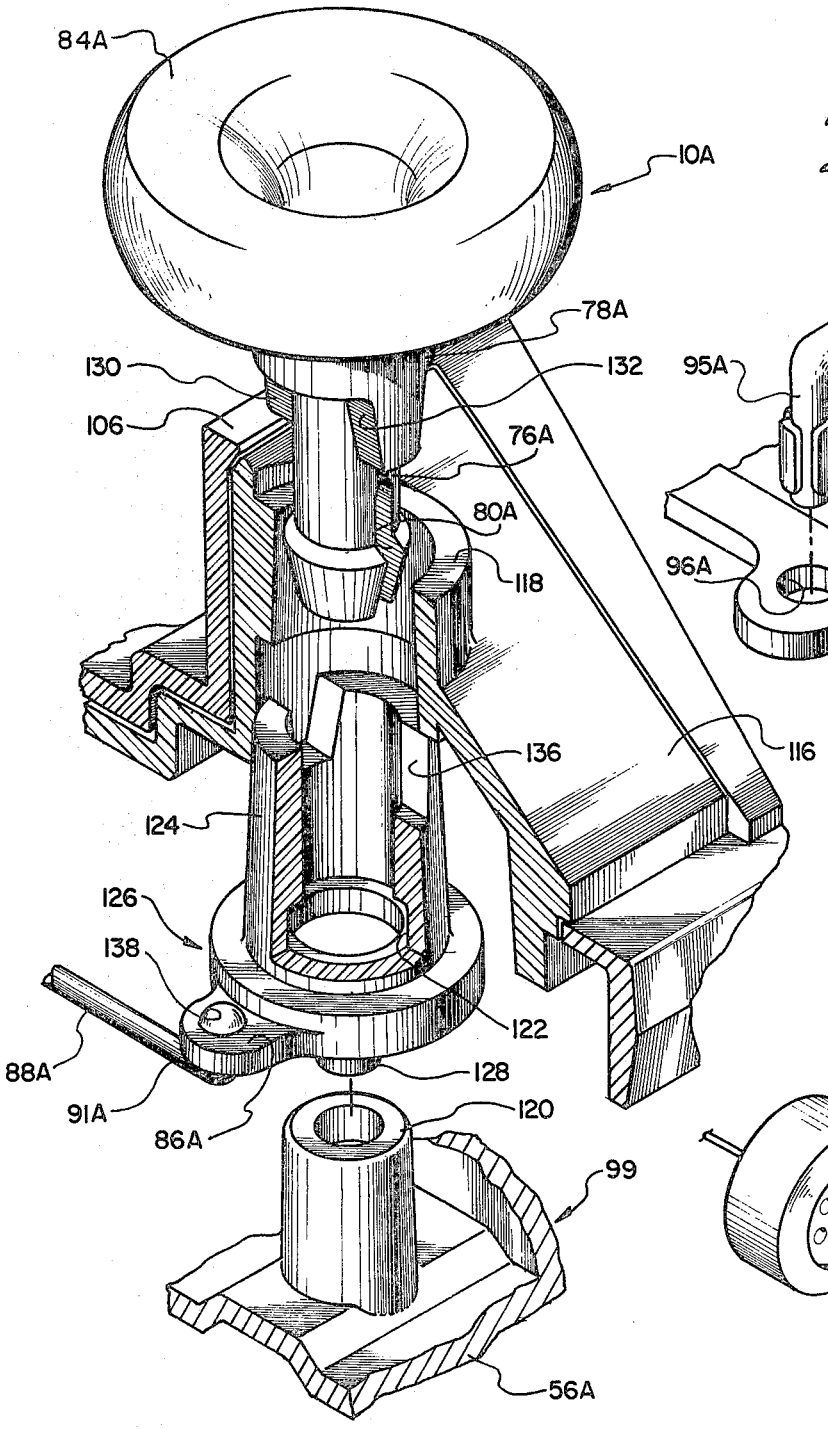
Fig. 9,
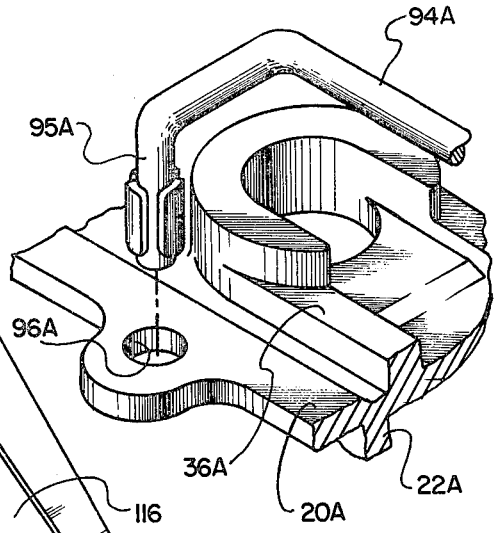
Fig. 10,
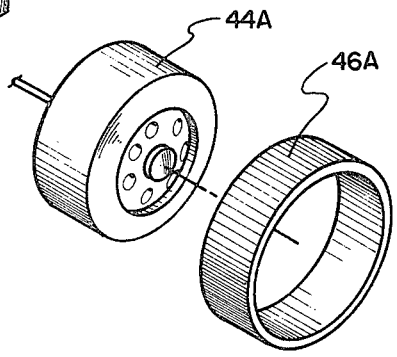
Fig. 11,

STEERING MECHANISM FOR TOY VEHICLES

DESCRIPTION

1. Technical Field

This invention relates generally to steering mechanisms for toy vehicles and more particularly, to a new and useful steering mechanism for a tractor-semi-trailer type vehicle.

Children often play with toy vehicles by pushing them along the floor. The child can cause a vehicle having non-steerable front wheels to turn a corner by scuffing the front wheels across the floor. However, when the vehicle is a truck pulling a semi-trailer, it is necessary to scuff all of the wheels of the tractor or truck across the floor in order to execute a turn. This, of course, is not very realistic.

2. Background Art

The prior art presently known to applicants is exemplified by U.S. Pat. No. 2,233,116; 2,642,700; 2,651,882 and 2,797,922. These patents disclose different arrangements for steering the front wheels of a truck pulling a semi-trailer.

Disclosure of Invention

The present invention is directed in brief to the provision of a novel steering mechanism in combination with a toy vehicle including a truck or tractor having a front end and a rear end, a semi-trailer and a pivot connecting the semi-trailer to the tractor.

The best mode currently contemplated for carrying out the invention includes the provision of a steering wheel rotatably mounted to the semi-trailer and a mechanism coupling the steering wheel to the rear end of the tractor laterally of the pivot for swinging the tractor about the pivot when the steering wheel is rotated, whereby the vehicle may be steered by manipulating the steering wheel.

In a first embodiment of the present invention, the coupling mechanism includes a steering shaft having an upper end and a lower end, bearing blocks rotatably mounting the steering shaft to the semi-trailer with the upper end positioned above the top wall and the lower end positioned below the bottom wall, a steering crank affixed to the lower end of the steering shaft and a steering link connecting the steering crank to the rear end of the tractor. The steering crank comprises a segment of a circular disc and two parallel links are used.

In a second embodiment of the present invention, a steering crank is formed integrally with the lower portion of a two-piece steering post and a single link is held in position between the upper surface of a semi-trailer chassis and a plate which covers the chassis and forms the floor of the semi-trailer.

The features of the present invention which are believed to be novel are set forth with particularity in the appended claims. The present invention, both as to its organization and manner of use, may best be understood by reference to the following description, taken in connection with the accompanying drawings in which like reference characters refer to like elements in the several views.

BRIEF DESCRIPTION OF DRAWINGS

FIG. 3 is a view similar to FIG. 2 with the steering mechanism set for turning the vehicle;

FIG. 5 is a top plan view of a steering mechanism constituting a second embodiment of the present invention in combination with a truck-semi-trailer type vehicle;

FIG. 6 is a view similar to FIG. 5 showing the steering mechanism set for turning the vehicle;

FIG. 9 is an enlarged, exploded, partial perspective view of the steering mechanism of FIG. 5;

FIG. 10 is an enlarged, exploded partial perspective view showing the manner in which the steering mechanism of FIG. 5 is connected to the truck of FIG. 5; and FIG. 11 is an exploded perspective view of a wheel and tire which may be used with the vehicles of FIGS. 1 and 5.

DISCLOSURE OF INVENTION

Figure 1:
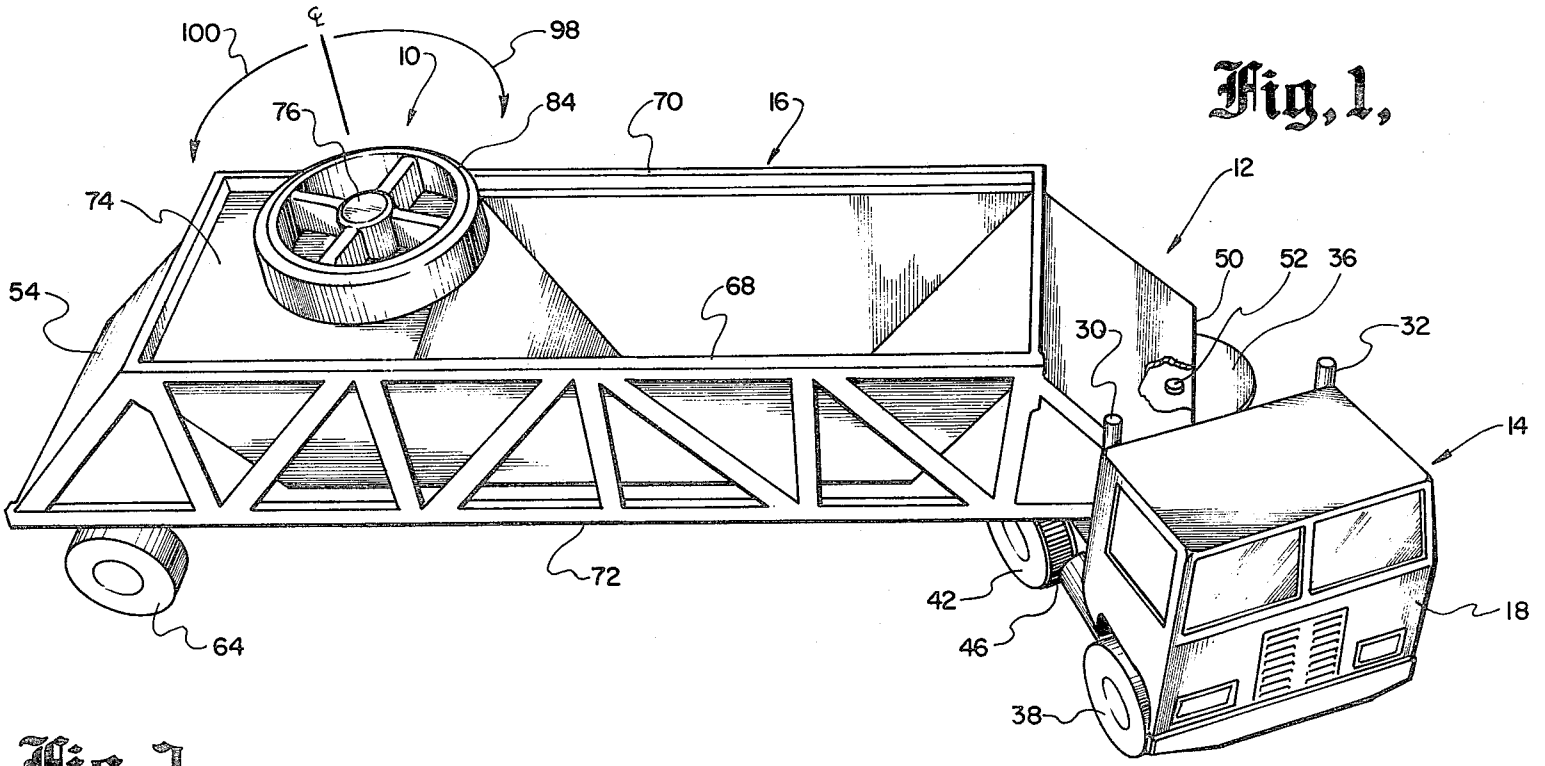
FIG. 1 is a perspective view, with parts broken away to show internal construction, of a steering mechanism constituting a first embodiment of the present invention in combination with a tractor-semi-trailer type vehicle.

Referring again to the drawings, a steering mechanism constituting a first embodiment of the present invention, generally designated 10, is shown in combination with a toy vehicle 12 including a truck or tractor 14 and a semi-trailer 16.

Tractor 14 has a front end 18 and a rear end 20 and includes a chassis 22 to which a closed cab 24, a pair of simulated fuel tanks 26, 28, a pair of simulated exhaust pipes 30, 32, and a simulated 5th wheel 36 are affixed. Tractor 14 also includes a pair of non-steerable front wheels 38, 40 and a pair of rear wheels 42, 44. Rear wheels 42, 44 are preferably provided with elastomeric tires or bands 46, 48, respectively, for increasing the friction between the rear wheels and a smooth surface upon which vehicle 12 may be manipulated by a child-user.

Semi-trailer 16 includes a front end 50, which is connected to 5th wheel 36 by a pivot 52, and a rear end 54, to which an axle support 56 is affixed by a clip 58 and a bolt 60. A pair of rear wheels 62, 64 are rotatably mounted on support 56 by an axle 66. Semi-trailer 16 is shown herein for purposes of illustration, but not of limitation, as comprising a hopper car having side walls 68, 70, a bottom wall 72 and a top wall 74 (FIG. 1).

Figure 4:
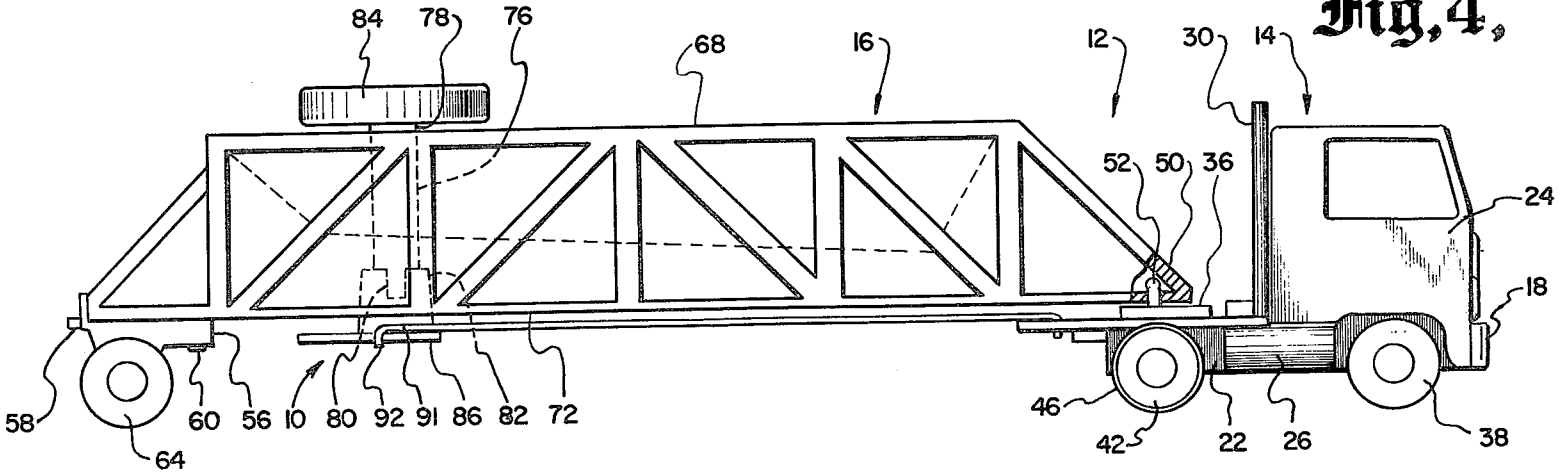
FIG. 4 is a side elevational view, with parts broken away to show internal construction, of the steering mechanism and vehicle of FIG. 1.
Figure 7:
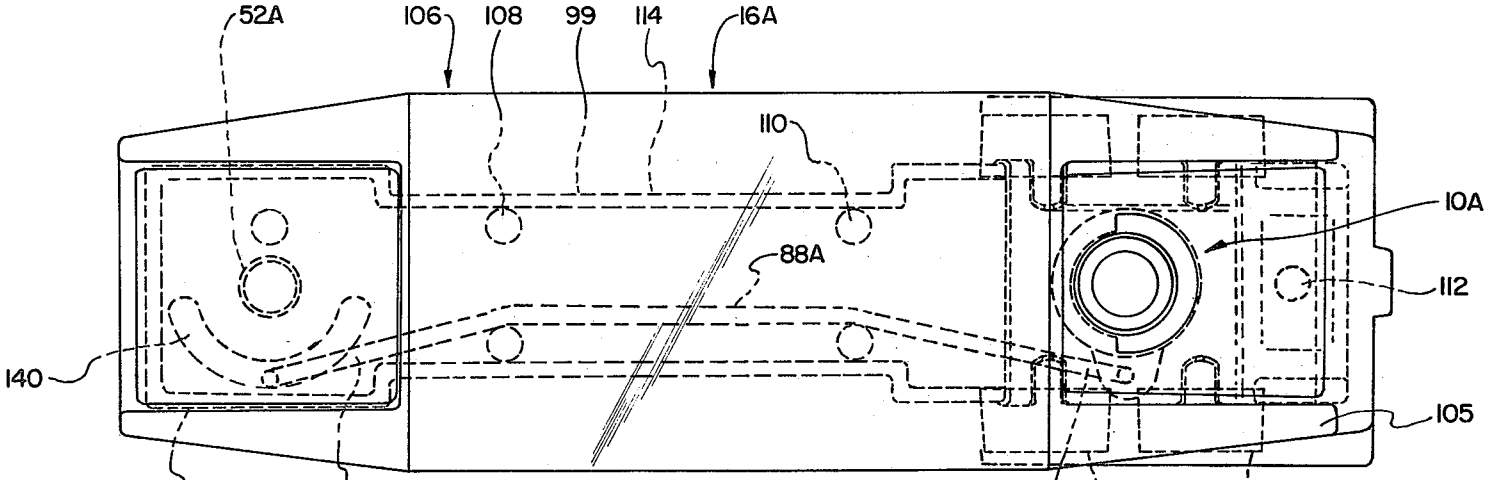
FIG. 7 is an enlarged, top-plan view showing a modification of the semi-trailer of FIG. 5.
Figure 8:
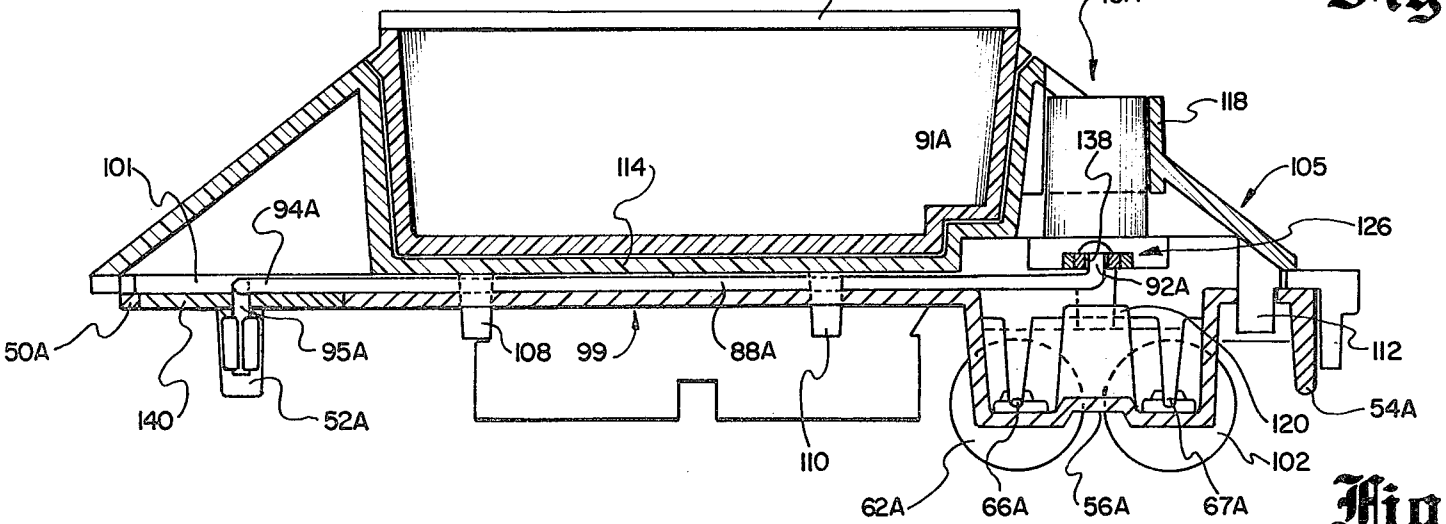
FIG. 8 is an enlarged, cross-sectional view of the semi-trailer of FIG. 7.

Steering mechanism 10 includes a steering shaft 76 having an upper end 78 (FIG. 4) journaled in top wall 74 and a lower end 80 journaled in an annular bearing block 82 affixed to the upper surface of bottom wall 72, as shown in broken lines in FIG. 4. Steering mechanism 10 also includes a steering wheel 84 affixed to the upper end of shaft 76 adjacent the upper surface of top wall 74 and a steering crank 86 affixed to the lower end of shaft 76 adjacent the lower surface of bottom wall 72. Crank 86 is shown herein for purposes of illustration, but not of limitation, as comprising a segment of a circular disc and is coupled to the rear end 20 of tractor 14 by a pair of steering links 88, 90 each provided with a rear end 91 having a hook 92 engaging an aperture 93 in crank 86 and a front end 94 having a hook 95 engaging an aperture 96 in rear end 20 of truck 14 laterally of pivot 52.

Figure 2:
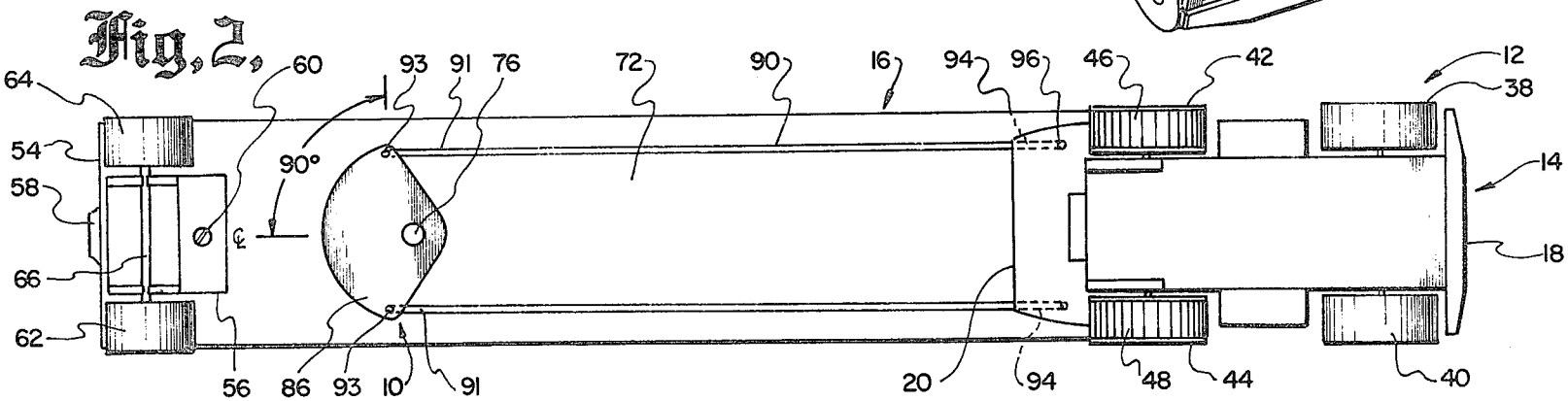
FIG. 2 is a bottom plan view of the steering mechanism and vehicle of FIG. 1 showing the steering mechanism holding the vehicle on a straight course.
Figure 1:
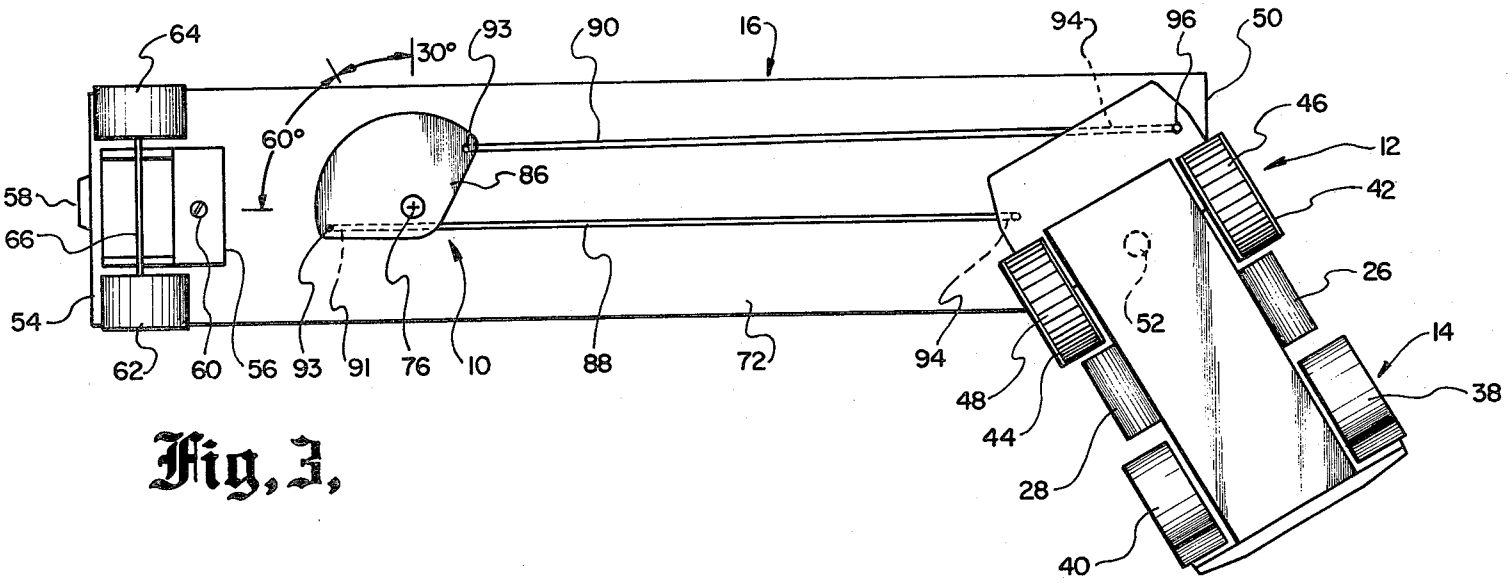

It is apparent from FIG. 2 that apertures 93 on crank 86 are 180° apart and 90° from the center-of-rotation of crank 86. Apertures 96 in end 20 of tractor 14 are positioned with respect to pivot 52 and with respect to apertures 93 in a manner such that links 88, 90 are parallel to each other when tractor 14 is aligned with semi-trailer 16 and that links 88, 90 will swing tractor 14 about pivot 52 when crank 86 is rotated.

Referring now to FIG. 3, when crank 86 is rotated approximately 60° clockwise, links 88, 90 will swing tractor 14 clockwise about pivot 52. It will, of course, be apparent to those skilled in the art that tractor 14 will be swung counterclockwise about pivot 52 when crank 86 is rotated counterclockwise. Sharper turns may be executed by rotating crank 86 more than 60° with the turning radius being limited in the clockwise direction by the engagement of end 91 of link 90 with link 88 and in the counterclockwise direction by the engagement of end 91 of link 88 with link 90.

Steering mechanism 10 and vehicle 12 may be made from suitable polymeric materials by well-known molding techniques or they may be die cast from suitable zinc material.

Operation of steering mechanism 10 is believed to be apparent from the foregoing and will now be briefly summarized in connection with FIG. 1.

A child user may rest the heel of his hand on top wall 54 while manipulating steering wheel 84 with his fingers to steer vehicle 12. Turning steering wheel 84 clockwise in the direction of arrow 98 causes vehicle 12 to execute a right turn by swinging truck 14 clockwise about pivot 52.

Rotating steering wheel 84 counterclockwise in the direction of arrow 100 causes the vehicle 12 to execute a left turn by swinging truck counterclockwise about pivot 52.

Referring now to FIGS. 5 and 6, a steering mechanism constituting a second embodiment of the present invention, generally designated 10A, is shown in combination with a toy vehicle 12A including a truck or tractor 14A and a semi-trailer 16A.

Tractor 14A has a front end 18A and a rear end 20A and includes a chassis 22A to which a closed cab 24A, a pair of simulated fuel tanks 26A, 28A, a pair of simulated exhaust pipes 30A, 32A, and a simulated 5th wheel 36A (FIG. 10) are affixed. Tractor 14A also includes a pair of nonsteerable front wheels 38A, 40A and two pairs of rear wheels 42A, 44A. Rear wheels 42A, 44A may be provided with elastomeric tires, as shown at 46A in FIG. 11, for increasing the friction between the rear wheels and a smooth surface upon which vehicle 12A may be manipulated by a child-user.

Referring now to FIGS. 5–9, semi-trailer 16A includes a chassis 99 having an encompassing, upstanding lip 101, a front end 50A, which may be connected to 5th wheel 36A by a post 52A depending from front end 50A, and a rear end 54A provided with a pair of axle supports 56A carrying a pair of axles 66A, 67A to which a first pair of wheels 62A, 64A and a second pair of wheels 102, 104, respectively, are mounted. Chassis 99 may be diecast, if desired, and chassis 99, lip 101, post 52A and axle supports 56A may be integrally formed.

Semi-trailer 16A also includes an inner body 105 and an outer body 106, each of which may be molded from a suitable polymeric material. Inner body 105 is affixed to chassis 99 by suitable depending pins, like the ones shown at 108, 110, 112 in FIGS. 7 and 8, and includes a bottom wall 114 which is supported by lip 101. Inner body 105 also includes a rear wall 116 provided with an annulus 118 (FIG. 9) communicating with an upstanding hollow post 120 formed integrally with axle supports 56A.

Steering mechanism 10A includes a steering shaft 76A (FIG. 9) having an upper end 78A journaled in annulus 118 and a lower end 80A trapped in an annular cavity 122 formed in the cylindrical wall portion 124 of a rod actuator 126 having a depending pin 128 journaled in post 120. Steering mechanism 10A also includes a steering wheel 84A and a pair of tangs 130, 132 formed integrally with shaft 76A. The tangs 130, 132 engage notches 134, 136, respectively, which are provided in the cylindrical portion of actuator 126 for coupling steering wheel 84A thereto. A steering crank 86A is provided on actuator 126 and is provided with an aperature 138. Crank 86A is coupled to the rear end 20A of tractor 14A by a steering link or rod 88A, provided with a rear end 91A having a hook 92A engaging aperture 138 in crank 86A and a front end 94A having a hook 95A extending through an arcuate slot 140 in chassis 99 into engagement with an aperture 96A in rear end 20A of truck 14A laterally of pivot 52A. Steering rod 88A is held in position between the upper surface of chassis 99 and the lower surface of inner body 105 with lip 101 providing clearance therebetween.

Operation of steering mechanism 10A is believed to be apparent from the foregoing and will now be briefly summarized in connection with FIGS. 5 and 6.

A child user may rest the heel of his hand on back wall 116 while manipulating steering wheel 84A with his fingers to steer vehicle 12A. Turning steering wheel 84A clockwise in the direction of arrow 98A causes vehicle 12A to execute a right turn by swinging truck 14A clockwise about pivot 52A.

Rotating steering wheel 84A counterclockwise in the direction of arrow 100A causes vehicle 12A to execute a left turn by swinging truck 14A counterclockwise about pivot 52A.

While the particular steering mechanisms herein shown and described in detail are fully capable of attaining the objects and providing the advantages hereinbefore stated, it is to be understood that they are merely illustrative of the presently-preferred embodiments of the invention and that no limitations are intended to the details of construction or design herein shown other than as defined in the appended claims, which form a part of this disclosure.

Whenever the term "means" is employed in the appended claims, this term is to be interpreted as defining the corresponding structure illustrated and described in this specification or the equivalent of the same.

We claim:

1. In combination with a toy vehicle comprising a tractor and a semi-trailer, said tractor including a pair of non-steerable front wheels, a pair of non-steerable rear wheels and a simulated fifth wheel intermediate said rear wheels, said semi-trailer including a front end, a rear end, a post depending from said front end of said semi-trailer for pivotably connecting said semi-trailer to said simulated fifth wheel and a rear wall, said rear wall sloping upwardly and forwardly from said rear end of said semi-trailer, said rear wall having a lower end and an upper end, a steering mechanism comprising:

an annulus mounted to said wall adjacent its upper end;

an upstanding hollow post mounted to said semi-trailer below said annulus;

a steering shaft having an upper end and a lower end;

a steering rod actuator including a pin depending from the lower end of said actuator, a pair of notches provided at the upper end of said actuator, an annular cavity formed in said actuator intermediate its ends and a steering crank mounted to said actuator adjacent said depending pin;

a steering wheel mounted to said upper end of said steering shaft;

a pair of tangs depending from said steering wheel, said upper end of said steering shaft being journalled in said annulus, said tangs being coupled to said notches, said lower end of said steering shaft including means trapping said lower end in said annular cavity and said depending pin being journalled in said hollow post;

a first aperture provided in said steering crank;

a second aperture provided in said tractor laterally of said simulated fifth wheel; and a steering link connecting said first aperture to said second aperture, whereby said vehicle may be steered by manipulating said steering wheel to swing said tractor about said post depending from said front end of said semi-trailer.

2. In combination with a toy vehicle including a tractor having a front end, a rear end, a pair of non-steerable front wheels and at least two non-steerable rear wheels, a semi-trailer having a top wall and a bottom wall and a pivot connecting said semi-trailer to said tractor, a steering mechanism comprising:

a steering shaft having an upper end and a lower end;

means rotatably mounting said steering shaft to said semi-trailer;

a steering wheel affixed to said upper end of said steering shaft; and means connecting the lower end of said steering shaft to said rear end of said tractor laterally of said pivot for swinging said tractor about said pivot when said steering wheel is rotated.

3. A combination as recited in claim 2 wherein said connecting means includes a steering crank affixed to said lower end of said steering shaft and a steering link connecting said crank to said rear end of said tractor.

4. A combination as recited in claim 3 wherein said steering crank comprises a segment of a circular disc.

5. A combination as recited in claim 3 wherein said upper end of said steering shaft is positioned adjacent the upper surface of said top wall and said lower end of said steering shaft is positioned adjacent the lower surface of said bottom wall.

* * * * *